United States Patent [19]

Petersen

[11] 4,133,196

[45] Jan. 9, 1979

[54] KEY CHAIN CONSTRUCTION

[76] Inventor: Gerald A. Petersen, 10 De Sabla Rd., #709, San Mateo, Calif. 94403

[21] Appl. No.: 831,439

[22] Filed: Sep. 8, 1977

Related U.S. Application Data

[63] Continuation-in-part of Ser. No. 712,764, Aug. 9, 1976, abandoned.

[51] Int. Cl.[2] ..... A44B 15/00

[52] U.S. Cl. ..... 70/457; 24/116 R

[58] Field of Search ..... 24/3 M, 3 K, 116 R; 70/457, 458, 459

[56] References Cited

U.S. PATENT DOCUMENTS 2,570,680 10/1951 Huizinga ..... 24/116 R

FOREIGN PATENT DOCUMENTS 486846 6/1938 United Kingdom ..... 70/457

*Primary Examiner*—Kenneth J. Dorner

*Attorney, Agent, or Firm*—Julian Caplan

[57] ABSTRACT

A key chain comprises a long chain of oblong links having one link of a length longer than the other links extending outward from a fitting formed with a cross-shaped aperture to permit movement of the chain through the aperture. The aperture has a slot extending out to an edge of the fitting. Only the elongated chain link will slide through the slot. Attached to the fitting is a medallion which may carry an advertising logo, owner identification data or other information or decoration. The outer end of the chain has a finger grip to facilitate grasping the chain to move the chain through the aperture until the elongated link is opposite the slot.

2 Claims, 5 Drawing Figures

KEY CHAIN CONSTRUCTION

This application is a Continuation-In-Part of my prior application Ser. No. 712,764, filed Aug. 9, 1976, which is to be abandoned.

This invention relates to a new and improved key chain construction wherein the keys are retained in a loop of a chain which passes through the conventional holes in keys. The invention is characterized by the fact that the loop is formed by the use of a fitting at one end of the chain provided with an aperture for sliding movement of the remaining portion of the chain therethrough and further formed with a cross-shaped slot to the outside of the fitting which accommodates passage only of an elongated link in the chain. The keys may be added or removed by opening the loop in the chain by passing the elongated link through the slot and then replacing the link and sliding the chain in either direction through the aperture. Unless the elongated link is in registry with the slot, the loop cannot be opened.

A particular feature and advantage of the application is the fact that the chain provides a positive containment for keys. No other chain means of retaining keys affords such positive containment. Key rings and clasps are more difficult to use and require considerable effort when keys are added or removed.

Another feature of the invention is the fact that the device is light in weight and is not bulky, as is the case in many types of key retainers. Since the material of construction is preferably metal or plastic, the construction may be attractive. This is particularly true in that the chain, medallion and fitting, hereinafter described, may be made of a precious metal.

Another feature of the invention is the fact that space is provided which is useful for identification, advertising or decoration.

The medallion attached to one end of the key chain is not only ornamental but is a convenient means for gripping the entire device, particularly as an aid to withdraw the chain from a pocket or purse. Preferably the medallion and the fitting through which the chain slides are fabricated integral to achieve a solid connection resulting in ease of operation.

The shape of the opening in the fitting of the medallion is such as to prevent the knob on the opposite end of the chain to pass therethrough. This permits use of a knob no larger than the widths of the chain links. Hence the knob will accept keys with holes small enough to barely accept the chain.

Other objects of the present invention will become apparent upon reading the following specification and referring to the accompanying drawings in which similar characters of reference represent corresponding parts in each of the several views.

Figure 1:
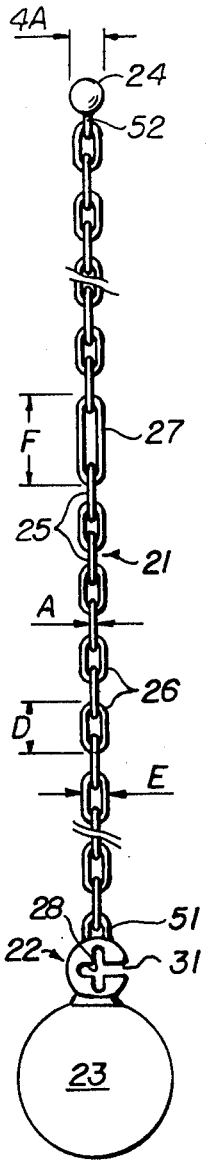
FIG. 1 is a plan view of one modification of the present invention showing the chain unlooped.

The key chain of the present invention comprises the chain proper 21, a fitting 22 at one end of chain 21, a medallion 23 integral with and disposed laterally of fitting 22 opposite the chain 21 and a knob 24 at the outer end of chain 21. The aforementioned parts may be made of the same or similar material which include plastics and metals including precious metals. The medallion 23 provides space on either surface thereof for identification of the owner, for logos and advertising messages or for ornamentation and decoration.

Chain 21 consists of a plurality of links 25 and 26 here shown as oblong wire links of the type used in many jewelry chains. Links 25 and 26 are identical, but alternate links are at right angles to each other. One link 27 of chain 21 is of special construction in that it differs from the links 25 and 26 in that it is longer than any of said links 25 and 26 and is made of the same size wire, or, optionally, thinner wire.

The fitting portion 22 of medallion 23 is shown as a generally circular disc of a specific thickness, which thickness is less than the free length of link 27 and greater than the space between links 25 and 26. Formed in fitting 22 and passing therethrough is an aperture 28 which is here shown as a generally Swiss cross form. The dimensions of the aperture 28 are sufficient to permit the loops of chain 21 to slide therethrough without interference. The cruciform shape prevents twisting of the chain. The use of a cruciform shape makes possible use of a small diameter for knob 24 since the four inward directed angles stop the knob in the position of FIG. 3. This also makes it easier to grip the knob with the fingers. A small diameter for knob 24 makes it possible to insert the same through the holes in keys of a size no larger than the widths of the links 25, 26, 27.

One of the branches of the cruciform aperture 28 is formed with a slot 31 which extends out to the periphery of the fitting 22. The width of slot 31 is greater than the thickness of link 27.

Half link 51 is integral with or fixed to fitting 22. A similar half link 52 is fixed to ball 24 and is connected to end links 25 or 26.

Each link 25 or 26 is formed of round (circular cross-section) wire of uniform diameter A, which in a preferred embodiment is 1 mm. The ends of the links are semi-circular arcs and the sides are straight. Referring then to the drawings:

D (overall length of link 25 or 26) = 5A
E (width of link 25, 26, and 27) = 4A
C (free space within link 25 or 26 between adjacent links) = A
F (overall length of link 27) = 9A
Thickness of fitting 22 = A + 2 mm
Diameter of knob 24 = 4A

Preferably there are twenty links 25, 26 between 22 and 27 and ten links 25, 26 between 27 and 24. D should exceed E by at least 25% to enable the chain to hang straight and untangled when held by medallion 23. The thickness of fitting 22 should exceed the space C by 2 mm to insure that the chain will not escape from the aperture in 22. If D is increased, then the thickness of fitting 22 is increased in like amount, so that the space C will always be substantially less than the thickness of fitting 22 so that no link but 27 can be used to open the loop.

F cannot be too long because the chain is flexible at the end of each link. F must, however, be long enough to be readily visible in semi-darkness or at least easily felt in darkness for easy operation.

Slot 31 extends from the outer edge 32 of fitting 22 to a terminus 33. A slot 34 at right angles to the slot 31 is spaced a distance at least ½ E from terminus 33.

There is a space between the adjacent links 25 or 26 at either end of link 27 which is sufficient to permit the link 27 to be pulled out through the slot 31 to release the chain from the fitting 22. Another feature of the fitting 22 is that the slots 31 and 34 are at right angles to each other and are of sufficient length and width so that the links 25, 26, which are disposed at right angles to each other, will slide through the slots 31, 34 without rotation of the chain.

Figure 4:
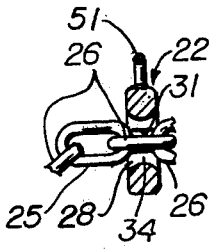
FIG. 4 is a sectional view similar to FIG. 3 showing the chain in a position whereby the chain is held looped.
Figure 2:
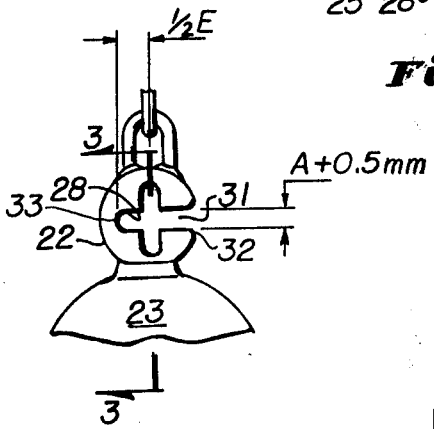
FIG. 2 is an elongated fragmentary view of a portion of the structure of FIG. 1.
Figure 5:
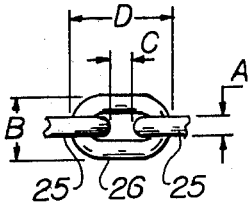
FIG. 5 is a fragmentary, enlarged view of a link and adjoining links with designations of dimensional proportions.

In use, referring to FIG. 4, the elongated link 27 is positioned so that it may slide in or out of the slot 31 so that the chain 21 is inside aperture 28 or outside fitting 22 as desired. Thus, when keys are to be added or removed, the loop is opened permitting the outer knob 24 to be inserted through the holes in the keys. Thereupon, the keys are slid down chain 21 toward the fitting 22. Link 27 is then inserted through the slot 31 so that the chain 21 is in registry with the aperture 28 and the position of the chain 21 is changed by sliding the chain so that the elongated link 27 is not in registry with the aperture 31.

When any portion of chain 21 other than the link 27 is in registry with the slot 31, the chain 21 cannot be removed because the space C between the links 25 and 26 is insufficient to permit escape from the fitting 22 because of the relative thickness of fitting 22. Thus FIG. 4 illustrates how the chain cannot be removed from the fitting 22 because the spacing between the upper and lower links 26 is insufficient to provide escape from the aperture 28. When, however, the elongated link 27 is in the position of the middle link 26 shown in FIG. 4, its length permits sliding through the slot 31; and for this purpose, the thickness of the link 27 is less than that of the slot 31.

Figure 3:
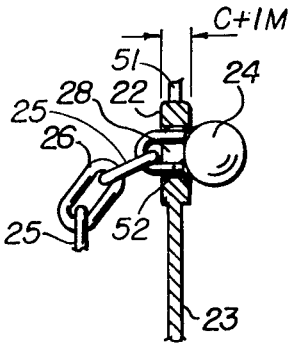
FIG. 3 is a sectional view taken substantially along the line 3—3 of FIG. 2 showing the chain held in the fitting.

The outer knob 24 facilitates insertion of the chain through the holes in the keys. As shown in FIG. 3, it also facilitates sliding the chain relative to the fitting 22 since it is easily gripped with the fingers. The size of the knob is such that it will not pass through the aperture 28, all as best shown in FIG. 3. Knob 24 preferably is of a size no greater than the widths of the links, thereby accepting any key having a hole large enough to pass the chain.

What is claimed is:

1. A key chain comprising an elongated chain having a plurality of first links, a plurality of second links interfitting into adjacent first links and normally oriented at right angles to said first links, each of said first and second links being similar and oblong in shape having parallel sides and semi-circular ends and being formed of wire of thickness "A", said links being of width "4A" and length "5A", a fitting fixed to a first end of said chain of a thickness about "3A", said fitting being formed with a first slot extending inward from an edge of said fitting to a terminus located a distance substantially greater than "4A" from said edge, a second slot at right angles to said first slot at a distance "2A" from said terminus, the widths of said slots being slightly greater than "A", the distance "5A" being such that neither said first nor said second links can slide through said first slot, said chain also having a third link oblong in shape and formed of wire of thickness "A" and width "4A" and a length of "9A" so that said third link can slide through said first slot, said third link being interposed between one of a pair of said first links or one of a pair of said second links, and a spherical knob of a diameter no greater than "4A" on a second end of said chain, said knob being large enough to prevent said second end from sliding out of said slots, said knob having a curvature great enough so that said knob will rest upon said fitting and not slip into said slots so that the user can grip said knob conveniently, said first links and said second links normally being disposed at oblique angles to each other when said chain is loose so that said links will not slip through said slots until said chain is manually extended to become taut, said first and second slots and said first, second and third links being dimensioned so that none of said links can rotate when in said first slot, said second slot or the intersection of said first and second slots.

2. A chain according to claim 1 which further comprises a medallion on said fitting.

* * * * *